US006220359B1

(12) United States Patent
Poulard

(10) Patent No.: US 6,220,359 B1
(45) Date of Patent: Apr. 24, 2001

(54) PUMP THROUGH SAFETY VALVE AND METHOD

(75) Inventor: Jason P. Poulard, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/251,773

(22) Filed: Feb. 17, 1999

Related U.S. Application Data

(60) Provisional application No. 60/106,722, filed on Nov. 2, 1998.

(51) Int. Cl.[7] ..... E21B 34/08

(52) U.S. Cl. ..... 166/373; 166/383; 166/386; 166/317; 166/324; 166/332.3; 166/334.4

(58) Field of Search ..... 166/317, 321, 166/324, 332.3, 332.7, 334.4, 386, 383, 373, 374

(56) References Cited

U.S. PATENT DOCUMENTS

| | | | | |
|---|---|---|---|---|
| Re. 32,343 | | 2/1987 | Vinzant et al. . | |
| 4,063,593 | | 12/1977 | Jessup . | |
| 4,113,018 | | 9/1978 | Barrington et al. . | |
| 4,372,391 | | 2/1983 | Barrington et al. . | |
| 4,372,392 | | 2/1983 | Barrington et al. . | |
| 4,542,792 | * | 9/1985 | Akkerman | 166/374 |
| 4,618,000 | | 10/1986 | Burris, II . | |
| 4,691,779 | | 9/1987 | McMahan et al. . | |
| 4,840,057 | | 6/1989 | Bingham . | |
| 4,856,595 | | 8/1989 | Upchurch . | |
| 4,884,633 | | 12/1989 | Le Gac et al. . | |
| 4,979,569 | | 12/1990 | Anyan et al. . | |
| 5,284,209 | | 2/1994 | Godfrey . | |
| 5,285,850 | | 2/1994 | Bayh, III . | |
| 5,337,826 | | 8/1994 | Barrington . | |
| 5,338,001 | | 8/1994 | Godfrey et al. . | |
| 5,411,097 | | 5/1995 | Manke et al. . | |
| 5,649,597 | * | 7/1997 | Riggenberg | 166/373 |
| 5,682,921 | | 11/1997 | Rawson et al. . | |
| 5,984,014 | * | 11/1999 | Poullard et al. | 166/374 |

* cited by examiner

*Primary Examiner*—William Neuder
*Assistant Examiner*—Zakiya Walker
(74) *Attorney, Agent, or Firm*—Paul I. Herman; John F. Booth

(57) ABSTRACT

A downhole safety valve and method of operating a safety valve are provided. In general, the safety valve includes a housing having an interior fluid flow passage therethrough and at least one circulating port in the housing for providing fluid communication between the interior fluid flow passage and the exterior of the housing. A piston is operatively positioned within the housing for movement between a first position and a second position in response to a fluid pressure differential between the interior fluid flow passage and the exterior of the housing. A slip is operatively connected to the piston, whereby over a first range of the movement of the piston the slip moves with the piston, and over a second range of the movement of the piston the slip does not move with the piston. A first valve is positioned within the housing for opening and closing the interior fluid flow passage of the housing, and a second valve is positioned within the housing for opening and closing the circulating port. An operative connection is provided between the slip and either one of the first and second valves, whereby the first range of the movement of the piston operates the one valve. An operative connection is provided between the piston and the other one of the first and second valves, whereby the second range of the movement of the piston operates the other valve. According to another aspect of the invention, the valves can be operated sequentially. For example, the range of movement of the piston can be structured such that when the piston moves from the first position to the second position, the first valve closes and then the second valve opens. When the piston moves in the reverse direction from the second position to the first position, the second valve closes and then the first valve opens.

46 Claims, 6 Drawing Sheets

100
210
212
222
314
318
224
214
332
316
400
910
420
312
912
900
200
914
220
330
712
322
710
320
716
326
714
324
700
300
740
750
730
720
102
722
810
800
726
850
724
310
830
232
522
820
822
524
234
826
526
824
528
512
510
520
514
516
530
562

500
532
564
560
550
230

PUMP THROUGH SAFETY VALVE AND METHOD

This application claims the benefit of U.S. Provisional Application No. 60/106,722, filed Nov. 2, 1998—entitled "Pump Through Safety Valve and Method"

TECHNICAL FIELD

The invention generally relates to valves for downhole use in oil and gas wells. More particularly, the invention relates to downhole safety valve.

BACKGROUND OF THE INVENTION

In oil and gas wells, uncontrolled downhole fluid pressures can cause a dangerous situation. Depending on the downhole conditions, it is usually possible to predetermine a threshold pressure differential between a higher fluid pressure in an area exterior of the downhole tubing string adjacent where a safety-valve is to be positioned, and a lower fluid pressure interior of the tubing string that is considered to present an undesirable or possibly dangerous situation. For example, excessive fluid pressure in a production zone that is unbalanced by fluid pressure interior of the tubing string adjacent the production zone may present a highly dangerous situation in which hydrocarbons and gases may be driven at uncontrolled pressures uphole through the tubing string. In extreme cases, this can result in a blow-out of the well. A safety valve is intended to automatically actuate when such a condition occurs.

Another situation where this type of tool is valuable is if a leak develops in the tubing string above the valve that allows fluid pressure to communicate into the annular, where annulus pressure is harder to control. In this situation, it would be advantageous to have a valve that would automatically shut in the well.

It would be advantageous to have a safety valve that could be re-opened in response to a sufficient increase in interior fluid pressure over the exterior fluid pressure, whereby the downhole fluids can be pumped through the safety valve back into the formation.

It would also be advantageous to have a safety valve that would open a circulating valve after closing the fluid flow through the safety valve, whereby fluid can be circulated between the tubing string and the annulus while the flow through the safety valve is closed.

To operate successfully in the harsh and remove downhole environments, a simple and reliable safety valve structure and method would be highly advantageous.

SUMMARY OF THE INVENTION

According to the invention, a safety valve is provided for downhole use in a well. In general, the safety valve includes a housing having an interior fluid flow passage therethrough and at least one circulating port in the housing for providing fluid communication between the interior fluid flow passage and the exterior of the housing. A piston is operatively positioned within the housing for movement between a first position and a second position in response to a fluid pressure differential between the interior fluid flow passage and the exterior of the housing. A slip is operatively connected to the piston, whereby over a first range of the movement of the piston the slip moves with the piston, and over a second range of the movement of the piston the slip does not move with the piston. A first valve is positioned within the housing for opening and closing the interior fluid flow passage of the housing, and a second valve is positioned within the housing for opening and closing the circulating port. An operative connection is provided between the slip and either one of the first and second valves, whereby the first range of the movement of the piston operates the one valve. An operative connection is provided between the piston and the other one of the first and second valves, whereby the second range of the movement of the piston operates the other valve.

The valves for controlling flow and for controlling circulation can be connected to be operated sequentially by the piston. For example, the range of movement of the piston is preferably structured such that when the piston moves from the first position to the second position, the first valve closes and then the second valve opens. When the piston moves in the reverse direction from the second position to the first position, the second valve closes and then the first valve opens. The second valve for controlling the circulation port is preferably located uphole of the first valve, which is normally expected to be the lower pressure side of the safety valve.

According to the invention of the safety valve, a break-away release is used that breaks in response to a predetermined force related to the fluid pressure exterior of the housing. The break-away release is adapted to break before the fluid pressure exterior of the housing can cause the piston to move. The break away release is preferably a rupture disk operatively positioned between the piston and the fluid pressure exterior of the housing.

The invention also includes a method of operating a downhole safety valve. The method includes the step of operatively mounting a piston in a housing for movement between a first position and a second position. The method also includes the step of operatively connecting a slip to the piston, whereby over a first range of the movement of the piston the slip moves with the piston, and over a second range of the movement of the piston the slip does not move with the piston. A first valve is positioned within the housing for opening and closing an interior fluid flow passage of the housing, and a second valve is positioned within the housing for opening and closing a circulating port between the interior fluid flow passage and the exterior of the housing. A slip is operatively connected to one of the first and second valves, whereby the first range of the movement of the piston operates the one valve. The piston is operatively connected to the other one of the first and second valves, whereby the second range of the movement of the piston operates the other valve. The step of exposing the piston to a fluid pressure differential between the interior fluid flow passage and the exterior of the housing causes to move the piston between the first position and the second position, thereby operating the first and second valves.

The steps of constructing and operating the downhole safety valve can be performed such that when the piston moves from the first position to the second position, the first valve closes and then the second valve opens; and when the piston moves in the reverse direction from the second position to the first position, the second valve closes and then the first valve opens. When the valve is oriented for downhole use, the second valve is preferably located uphole of the first valve.

The inventive method includes the step of operatively positioning a break-away release that breaks in response to a predetermined force related to the fluid pressure exterior of the housing. The break-away release is adapted to break before the fluid pressure exterior of the housing can cause the piston to move. The break away release is preferably a rupture disk operatively positioned between the piston and the fluid pressure exterior of the housing.

These and other aspects and advantages of the invention will become apparent to persons skilled in the art from the following drawings and detailed description of a presently most preferred embodiment of the invention.

BRIEF DESCRIPTION OF THE DRAWING

The accompanying drawings are incorporated into and form a part of the specification to provide illustrative examples of the present invention and to explain the principles of the invention. The drawings are only for purposes of illustrating preferred and alternate embodiments of how the invention can be made and used. It is to be understood, of course, that the drawings are not to engineering scale, but are merely intended to represent and illustrate the concepts of the invention. The drawings are not to be construed as limiting the invention to only the illustrated and described examples. Various advantages and features of the present invention will be apparent from a consideration of the accompanying drawings in which.

By pumping fluid from up-hole to increase the fluid pressure at a faster rate than can be bled off through the interior port and exterior port of the circulating valve assembly, the increased fluid pressure drives the operating piston assembly back to the initial position, thereby selectively re-closing the circulating valve and then re-opening the flow valve.

DETAILED DESCRIPTION OF A PRESENTLY MOST PREFERRED

EMBODIMENT AND BEST MODE OF PRACTICING THE INVENTION

General Structure of a Safety Valve According to Invention

Figure 1A:
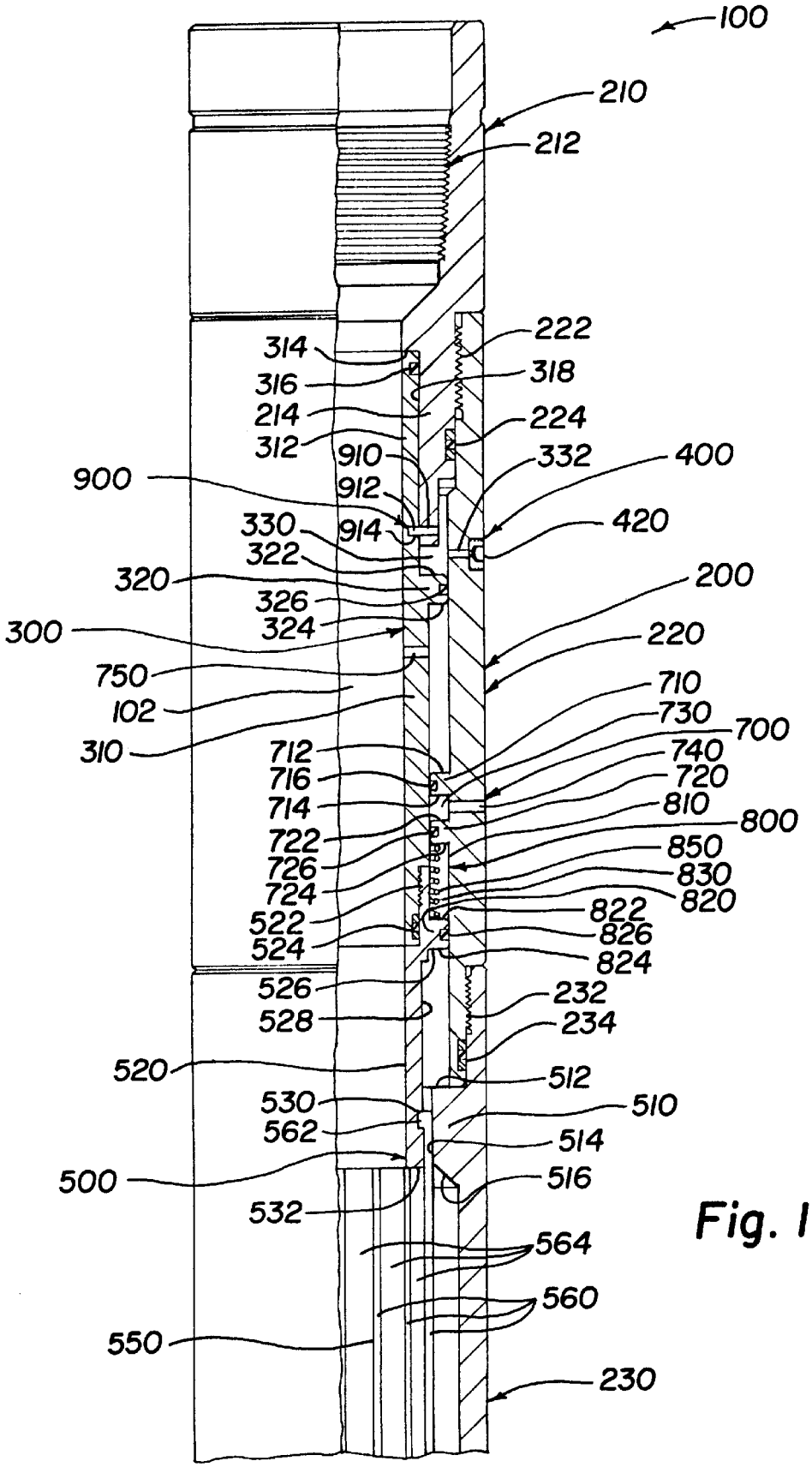
FIGS. 1A–B illustrate a schematic vertical section view of a representative safety valve according to the invention, which is shown in the initial position.
Figure 1B:
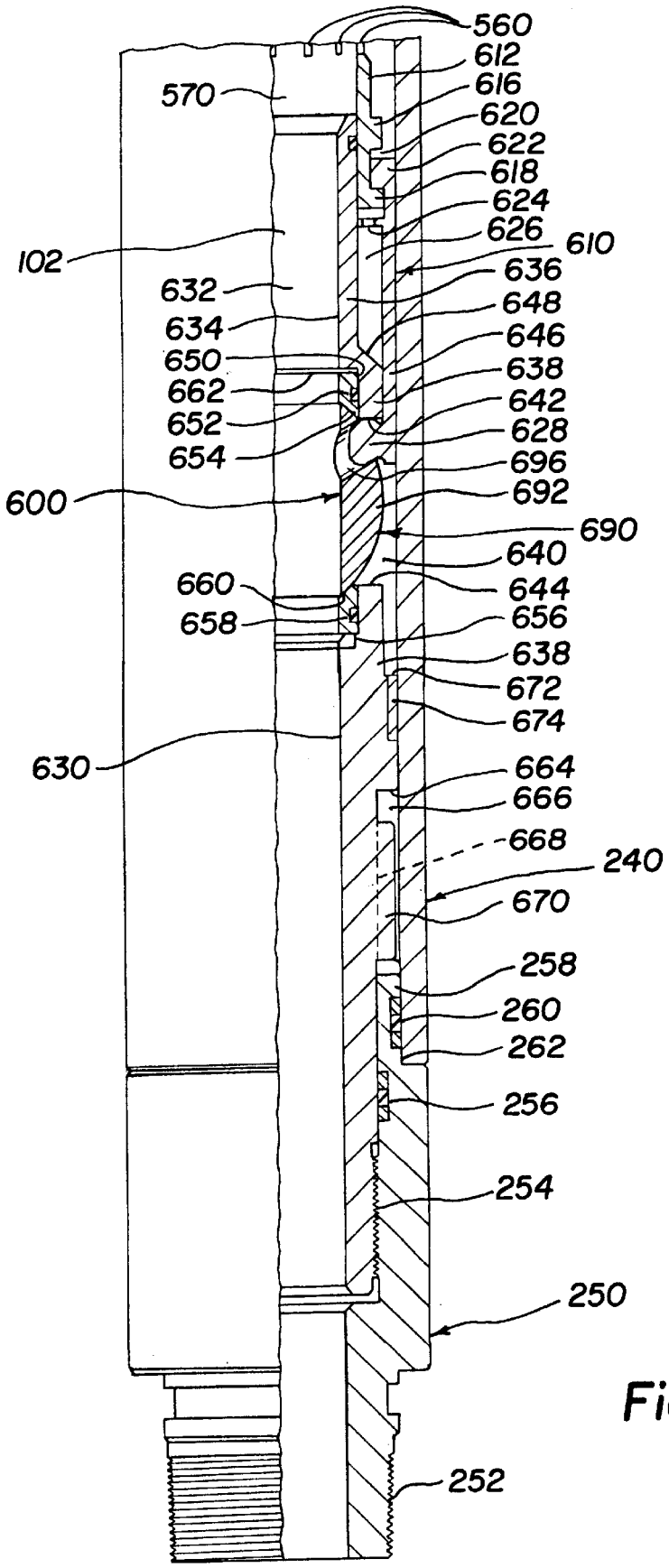

FIGS. 1A–B illustrates a preferred embodiment of a safety valve according to the invention, which is generally referred to by the reference numeral 100. As will be appreciated by persons skilled in the art, the safety valve 100 is generally tubular and shown in partial section. The safety valve 100 encloses an interior fluid flow conducting passage 102 extending through the safety valve. The flow conducting passage 102 is intended to be a section of a flow conducting passage through a tubing string extending upward and/or downward from the safety valve 100.

In general, a preferred embodiment of a safety valve 100 according to the invention can be described and characterized as including the following cooperative structures: a housing 200, a piston assembly 300, a break-away release 400, a slip assembly 500, a flow valve assembly 600, and a circulating valve assembly 700. According to a presently most preferred embodiment of the invention, the safety valve 100 also includes a biasing assembly 800 and a shear pin assembly 900.

It is to be understood, however, that merely because a structure or feature is conveniently described or referenced herein as being part of a general structure or function is not necessarily to be construed as a limitation on the invention thereby. The various structures and features described herein with respect to the presently most preferred embodiment of the invention interact to form an operative safety valve 100 according to the principles of the invention. These structures could be described with different terminology according to a different organizational structure and with different reference numerals without departing from the scope of the invention as defined by the appended claims.

As may be appreciated by reference to the drawings, connections of the various components are often complimented by the use of O-rings or other conventional seals. The use of such seals is well known in the art and, therefore, will not be discussed in detail.

The safety valve is shown in a vertical orientation, based on a typical orientation at a downhole location. It is to be understood, of course, that the safety valve can be in any orientation down-hole, even completely upside down relative to the drawings herein. The terms "upper," "lower," "up-hole," "down-hole," "above," and "below" and other such relative terms are only for the purpose of convenient reference to the drawings, and are not to be construed as limiting the use or operation of the safety valve 100. Similarly, terms such as "inner," "outer," "inward," and "outward" are used to indicate radial location or direction with reference to the interior of the safety valve 100.

As used herein, the term "tubing" generally includes casing, liner, tubing, or production tubing and strings of any such tubing.

As used herein, the term "exterior" of the housing can be the well formation or it can be an annular space outside the housing defined by the outer wall surface of the housing and the inner wall surface of an exterior tubing string, such as in the case where the safety valve is used in a production tubing string within a casing string.

Housing 200

The exterior housing 200 can be designed in many different structural embodiments to accommodate engineering considerations such as component manufacturing, assembly, and safety valve maintenance. The general functions of the housing 200 are to be the structural body of the safety valve 100 and to isolate the interior flow conducting passage 102 of the safety valve from the exterior of the safety valve. If desired, and in the normal case, the housing 200 can also be structurally engineered to function as a section of a downhole tubing or tubing string.

According to a presently most preferred embodiment, the housing 200 defines a substantially continuous outer cylindrical wall surface, which is adapted to match the outer diameter of the tubing string in which the safety valve 100 is to be employed. The overall length of the safety valve 100 is at least sufficient to accommodate a piston assembly 300, a slit assembly 500, a flow valve assembly 600, and a fluid circulating assembly 700.

The housing 200 is preferably formed from several components, which accommodates engineering considerations such as assembly and maintenance of the safety valve 100. According to the presently most preferred embodiment of the invention, commencing at the top of FIGS. 1A–B and working down, the housing 200 includes an upper connector 210, a upper housing section 220, a lower housing section 230, and a lower connector 250. It is to be understood, of course, that the fewer or additional housing sections can be used to form a housing suitable for use in a safety valve according to the invention. For example, lower housing section 230 may advantageously be formed from two sections having a threaded and sealed connection to further facilitate assembly of the safety valve 100. The upper connector 210 and lower connector 250 are not necessary to the housing 200 or to the practice the invention, but are merely the presently most convenient structure for integrating the safety valve 100 into a downhole tubing string.

The upper connector 210 can be either a male or female threaded connector. According to the presently most preferred embodiment illustrated in the drawings, the upper connector 210 is a female or bell connector of conventional engineering design having interior female threads 212 at the upper end thereof, whereby the safety valve 100 can be connected into a tubing string having a mating male or pin connector (not shown). As will hereinafter be described in detail, the upper connector 210 protrudes at its lower end 214 between the upper end of upper housing section 220 and the upper end of the piston assembly 300.

The upper housing section 220 is connected to the upper connector 210 at threaded connection 222. An O-ring seal 224 seals the threaded connection 222. According to the presently most preferred embodiment of the invention, the upper housing section 220 includes structures that can be more conveniently described in detail with respect to the piston assembly 300, break-away release 400, the fluid circulating assembly 700, the biasing assembly 800, and the shear pin assembly 900.

The lower housing section 230 is connected to the upper housing section 220 at threaded connection 232. An O-ring seal 234 seals the threaded connection 232. According to the presently most preferred embodiment of the invention, the lower housing section 230 includes structures that can be more conveniently described in detail with respect to the slip assembly 500 and the flow valve assembly 600

The lower connector 250 can be either a male or female threaded connector. According to the presently most preferred embodiment illustrated in the drawings, the lower connector 250 is a male or pin connector of conventional engineering design having exterior male threads 252 at the lower end thereof, whereby the safety valve 100 can be connected to a tubing string having a mating female or box connector (not shown).

According to the presently most preferred embodiment of the invention, and as will hereinafter be described in detail with respect to the flow valve assembly 600, the lower connector 250 is connected to the lower housing section 230 through the flow valve assembly 600. The flow valve assembly 600 is retained within the lower housing section 230 and the lower connector 250 is connected to the flow valve assembly 600 at threaded connection 254. An O-ring seal 256 seals the threaded connection 254. The lower connector 250 protrudes at its upper end 258 between the lower end of lower housing section 230 and the lower end of flow valve assembly 600. Another O-ring seal 260 seals the junction 262 between the lower housing section 230 and the lower connector 250. It is to be understood, of course, that the lower connector 250 can be connected directly to the lower housing section 230 by a threaded connector and O-ring seal. The connection of the lower connector 250 through the flow valve assembly 600, however, provides a structure that facilitates the assembly of the safety-valve 100.

Based on the invention disclosure herein, a person of skill in the art would be able to adapt the principles of the present invention and the details of the presently most preferred embodiment to employ a different housing design without departing from the scope of the present invention.

Piston Assembly 300

The piston assembly 300 is adapted to employ the principle of a piston to provide the selective driving movements to operate the flow valve assembly 600 and the circulating valve assembly 700. According to the presently preferred embodiment of the invention, a fluid pressure exterior of the housing is used to drive the piston assembly in a first direction to first close the flow valve assembly 600 and then, after the flow valve assembly is completely closed, to open the circulating valve assembly 700. A fluid pressure interior of the housing is used to drive the piston assembly in a second or reverse direction to first re-close the circulating valve assembly 700, and then re-open the flow valve assembly 600.

According to the presently most preferred embodiment of the invention, the piston assembly 300 comprises a operating mandrel 310 captured for slidable movement within the housing 200, and more particularly for movement within the upper housing section 220 of the housing 200, a mandrel piston 320, and an expansion chamber 330.

The upper end 312 of the operating mandrel 310 is adapted to be stopped by the shoulder 314 formed on the upper connector 210 of the housing 200, thereby limiting the upward slidable movement of the operating mandrel 310. The upper end 312 of the operating mandrel 310 has an O-ring seal 316, which seals the upper end of the operating mandrel for slidable movement against an inner landing surface 318 of the upper connector 210.

The outer wall of the operating mandrel 310 has a circumferential outwardly extending mandrel piston 320 formed thereon. The mandrel piston 320 has an upwardly-facing circumferential surface 322, a downwardly-facing circumferential surface 324. An O-ring seal 326 seals the mandrel piston 320 for slidable movement against the inner wall surface of the upper housing section 220.

An expansion chamber 330 is defined by the inner wall surface of the upper housing section 220 and the outer wall surface of the operating mandrel 310, the upper end of which is defined by the lower portion 214 of the upper connector 210, and the lower end of which is defined by the upwardly-facing circumferential surface 322 of the mandrel piston 320. The expansion chamber 330 can be a channel or, more preferably, is an annular chamber. One or more ports 322 formed in the upper housing section 220 can provide fluid communication between the expansion chamber 330 and the exterior of the housing 200. Additional ports 332 (not shown) can be spaced around the upper housing section 220 in positions that communicate with the annular expansion chamber 330.

Downwardly facing surfaces such as the surface 324 on the mandrel piston 320 and/or other such surfaces formed on the operating mandrel 310 or translated through to the operating mandrel 310 that are exposed to the fluid pressure within the interior flow conducting passage 102 and/or other biasing forces can be used as piston surfaces to drive the operating mandrel 310 of the piston assembly 300 back upwards. To do so, such pressures and/or other biasing forces need to be sufficient to overbalance the exterior fluid pressure exerted on the upwardly facing surface 322 of the mandrel piston 320.

Thereby, the operating mandrel 310 of the piston assembly 300 reciprocates in response to differential fluid pressures between the interior flow conduction passage 102 and the exterior of the housing.

Based on the invention disclosure herein, a person of skill in the art would be able to adapt the principles of a piston assembly 300 according to the present invention and the details of the presently most preferred embodiment described herein and illustrated in the drawings to employ alternative embodiments for the piston assembly 300 and mandrel piston 320 without departing from the scope of the invention.

Break-Away Release 400

According to the invention, a break-away release 400 is provided that ruptures, shears, or otherwise breaks free in response to a force related to an exterior fluid pressure. After the break-away release breaks, the fluid pressure exterior of the housing can act to drive the mandrel piston 320 of the piston assembly 300. According to the presently most preferred embodiment of the invention, the break-away release 400 is a rupture disk 420 positioned in each of the one or more ports 332. The physical characteristics of the rupture disk 420 are adapted such that the rupture disk will rupture in response to a predetermined pressure differential across the rupture disk 420. Upon rupturing, the external fluid pressure will be communicated through the port 332 into the expansion chamber 330 and be exerted against the upwardly-facing circumferential surface 322 of mandrel piston 320, which will tend to drive the entire operating mandrel 310 to slide downward in the housing 200.

Slip Assembly 500

According to a preferred embodiment of the invention, a first range of reciprocal movement provided by the piston assembly 300 is preferably used to quickly operate the flow valve assembly 600 and close the safety valve 100, and then, after the flow valve assembly 600 is fully closed, the slip assembly 500 slips such that a second range of reciprocal movement provided by the piston assembly 300 is not further transferred to the flow valve assembly 600. The second range of reciprocal movement provided by the piston assembly 300 is preferably used to operate the circulating valve assembly 700 and open fluid circulating ports, which will allow for fluid circulation and gradually equalize the interior and exterior fluid pressures between the interior and exterior of the housing 200 on one side of the flow valve assembly 600.

According to the presently most preferred embodiment of the invention, the slip assembly 500 generally includes a landing 510, a mandrel extension 520, and a collet 550.

The landing 510 can be formed on the upper end of the lower housing section 230. The landing 510 includes an upwardly-facing upper shoulder 512, an inwardly-facing landing surface 514, and a ramped lower shoulder 516.

The mandrel extension 520 is connected to the lower end of the operating mandrel 310 at threaded connection 522. An O-ring seal 524 is preferably used to seal the threaded connection 522, which is advantageous if the safety valve 100 includes a biasing assembly 800 as hereinafter described in detail. The mandrel extension 520 essentially is a downward extension of the operating mandrel 310 and moves with the operating mandrel 310. The threaded connection 522 for the mandrel extension 520 is intended to facilitate the assembly of the safety valve 100.

The downwardly-facing circumferential surface 324 of the mandrel piston 320 preferably is adapted to be stopped by a shoulder. As will hereinafter be described in more detail, according to the presently most preferred embodiment of the invention, such a shoulder is preferably an upwardly-facing circumferential surface 712 of a circumferential inwardly-extending first isolating rib 710 formed on the inner wall surface of the upper housing section 220. The mandrel extension 520 alternatively or additionally can have downwardly-facing surface 526 adapted to be stopped by the upwardly-facing upper shoulder 512 of the landing 510 formed on the inner wall of the upper housing section 220 of the housing 200, thereby limiting the downward slidable movement of the operating mandrel 310 and mandrel extension 520.

Accordingly, the mandrel extension 520 to the operating mandrel 310 operatively connects the slip assembly 500 to the piston 320 of the piston assembly 300.

The mandrel extension 520 has an outer diameter that is less than the inner diameter of the circumferential landing 510. The outer wall surface 528 of the mandrel extension 520 has a circumferential recess 530 formed therein for engaging with the collet 550.

The downwardly facing surfaces 526 and also 532 at the bottom of the mandrel extension 520 can be used as piston surfaces to move the mandrel extension 520 and the operating mandrel 310 back upwards, as will hereinafter be described in detail.

The collet 550 includes a plurality of collet fingers 560 extending upwardly from a lower sleeve portion 570. Each of the collet fingers 560 has an knuckle 562. The plurality of collet fingers 560 are separated from one another by appropriately sized radial gaps 564.

As will be appreciated by persons skilled in the art, the recess 530 in the mandrel extension 520 has ramped surfaces thereon for interacting with and guiding corresponding ramped surfaces on the knuckles 562 of the fingers 560 of the collet 550. The plurality of collet fingers 560 are adapted to resiliently grip and engage the mandrel extension 520 such that when the knuckles 562 of the collet fingers 560 are vertically aligned with the recess 530, the fingers 560 are urged inwardly to engage the recess 530. The finger knuckles 562 have various ramped surfaces formed thereon to facilitate the one-way slip function of the collet assembly 500.

In the initial position shown in FIGS. 1A–B of the drawing, the collet fingers 560 are trapped in the annular collet space 540 between the outer wall surface 528 of the mandrel extension 520 and an inner wall surface 514 of the landing 510 formed on the housing 200, thereby creating a secure latch. When the operating mandrel 310 begins to slide downward, the mandrel extension 520 and the collet 550 are also moved downward.

Figure 2A:
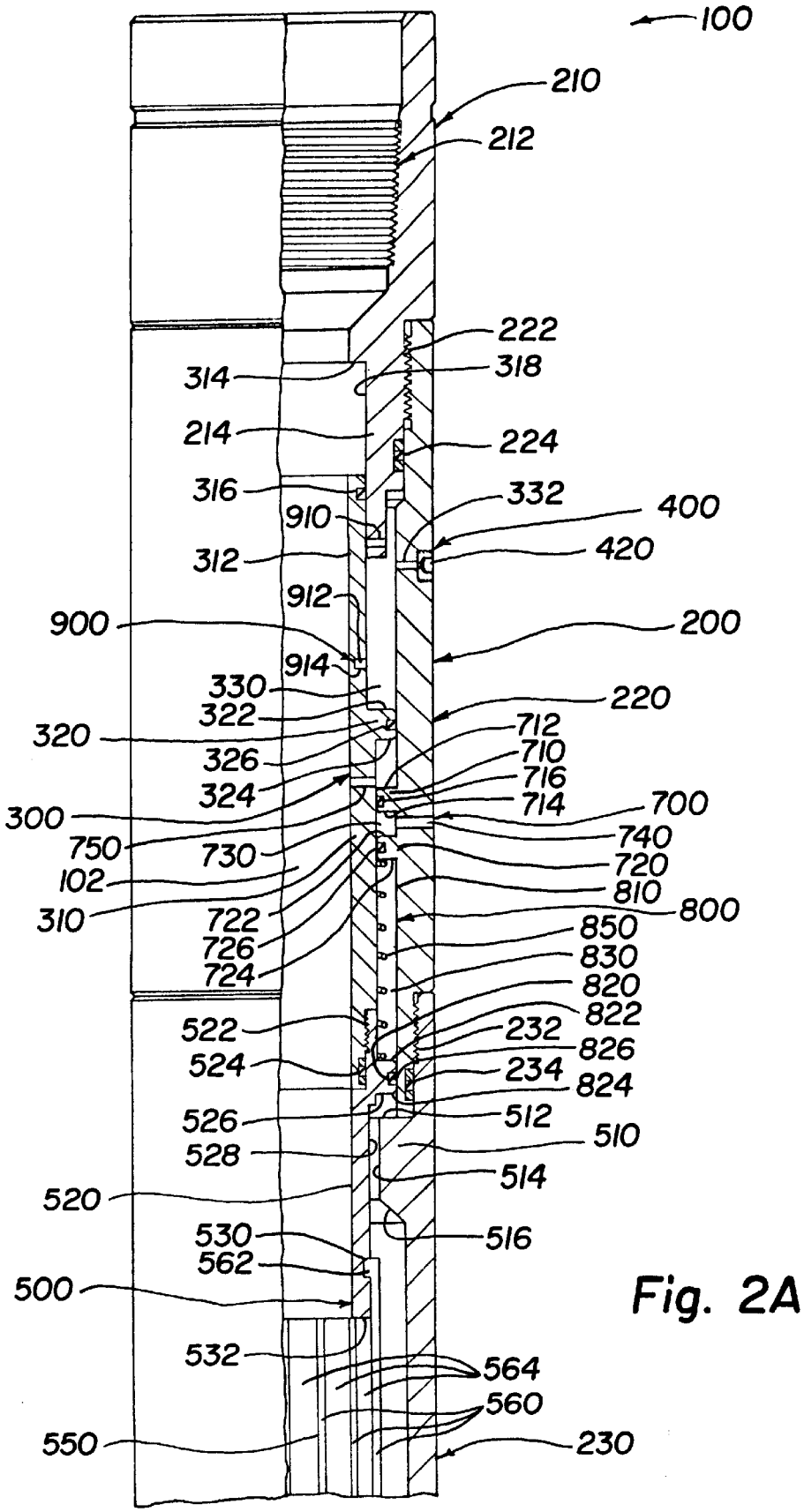
FIGS. 2A–B illustrate a schematic vertical section view of the representative safety valve shown in FIGS. 1A–B, after excessive exterior fluid pressure has caused the rupture disks to rupture and then at least assists in driving the operating piston assembly, acting through the slip assembly, to an intermediate position and close the flow valve assembly.
Figure 2B:
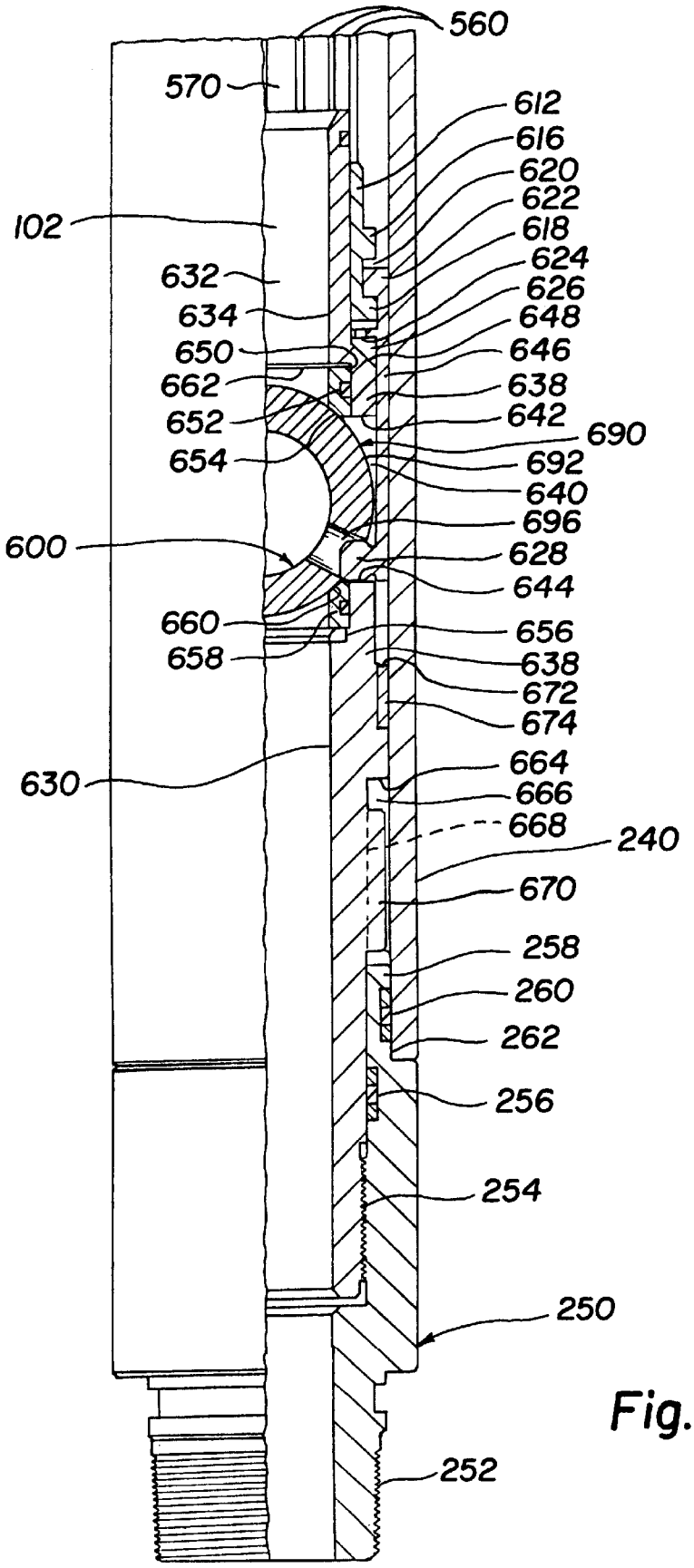

After being moving downward into the position shown in FIGS. 2A–B to the point that the finger knuckles 562 pass the lower shoulder 516 of the landing 510 formed on the valve housing 230, the finger knuckles 562 are no longer trapped between the inwardly-facing landing surface 514 of the landing 510 and outer wall surface 528 of the mandrel extension 520. At that position, the downward sliding movement of the collet 550 is stopped by the end of the closing motion of the flow valve assembly 600, as will hereinafter be described in detail. The continued downward movement of the operating mandrel 310 and the mandrel extension 520 creates an urging force against appropriately ramped surfaces between the recess 530 and the finger knuckles 562, urging the collet fingers 560 to spread radially apart from each other and disengage the recess 530 formed in the mandrel extension 520, which position is illustrated in FIGS. 2A–B.

Figure 3A:
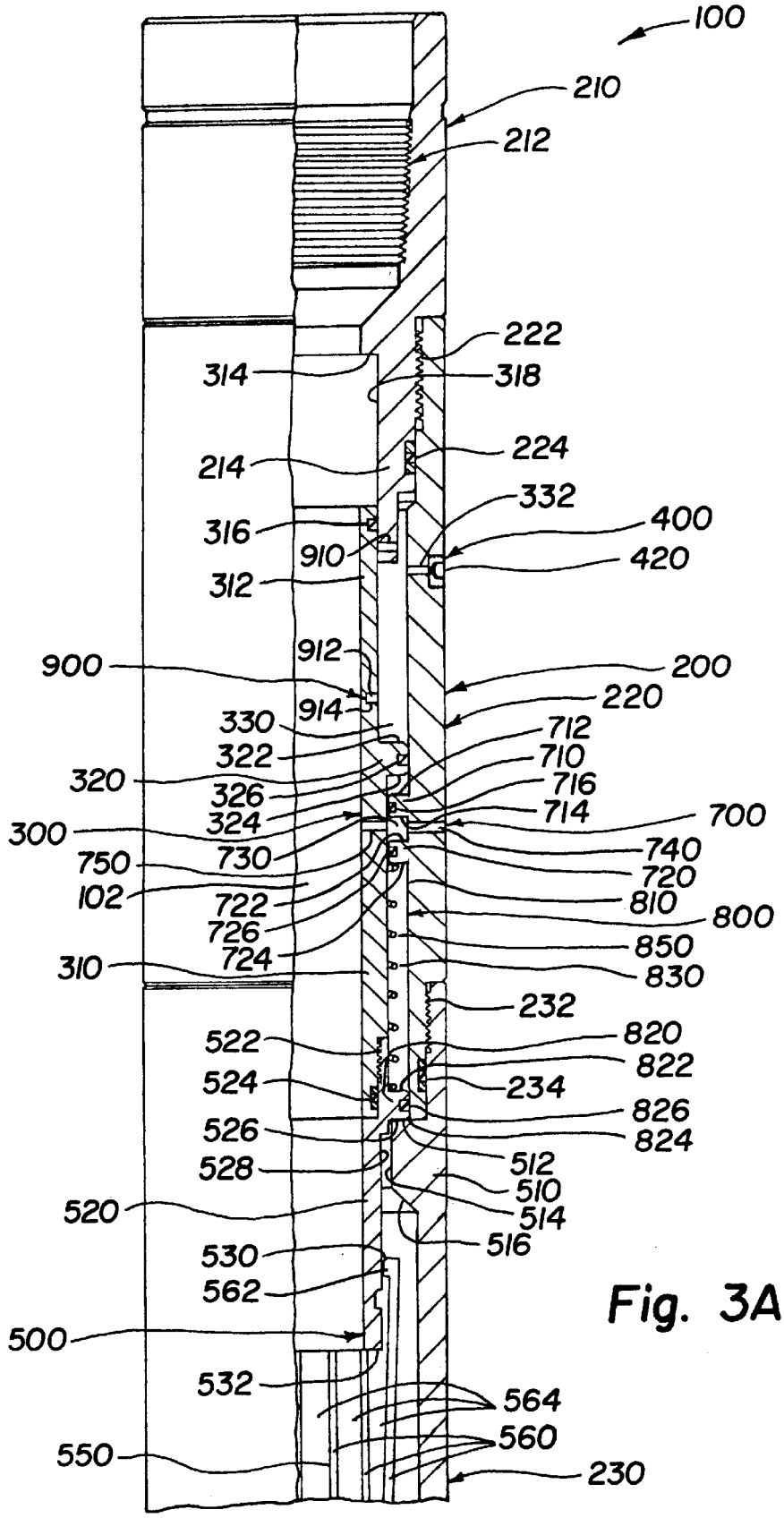
FIGS. 3A–B illustrate a schematic vertical section view of the representative safety valve shown in FIGS. 1A–B, after the flow valve assembly has been completely closed as shown in FIGS. 2A–B, at which point the slip assembly performs its slipping function to allow the exterior fluid pressure to continue to at least assist in driving the operating piston assembly to a second position at which an interior port and an exterior port of the circulating valve assembly are in fluid communication. The exterior fluid pressure communicates with the interior of the safety valve on the up-hole side of the safety valve.
Figure 3B:
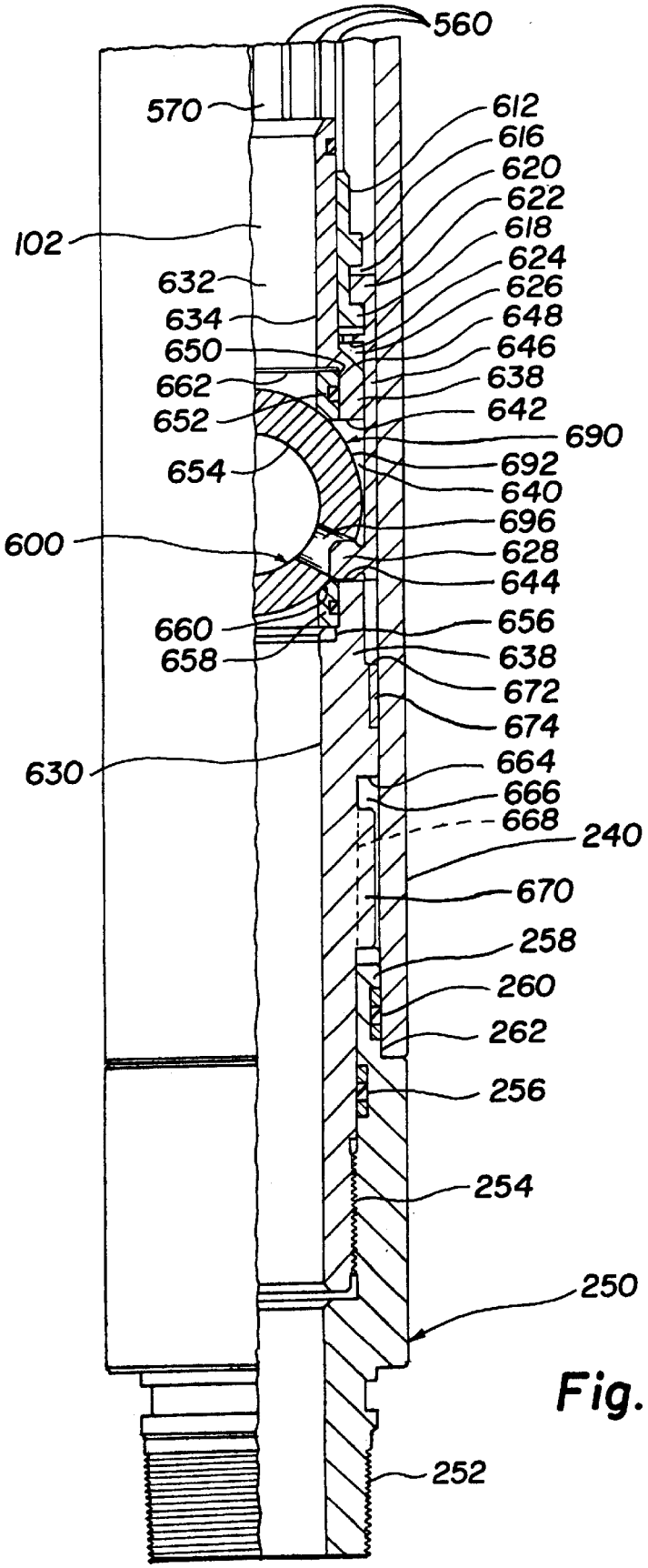

After spreading apart and disengaging the recess 530 in the mandrel extension, the recess 530 of the mandrel extension 520 is free to slip past the finger knuckles 562 of the stopped collet 550, such that the operating mandrel 310 and the mandrel extension 520 are free to continue moving downward to the third position shown in FIGS. 3A–B.

A substantially circumferential space is defined between the lower surface 526 and the upper surface 512. This space can remain in fluid communication with the interior passage 102 of the safety valve 100 via the gaps 564 between the collet fingers 360. As will hereinafter be described in detail, if the biasing assembly 800 is sealed, fluid pressure within the interior fluid flow conducting passage 102 can be used to exert an upward driving force against the lower shoulder 526 of the mandrel extension 520 to drive the mandrel extension 520 and the operating mandrel 310 upward, whereby the flow valve assembly 600 can be re-opened as will hereinafter be described in detail. If the biasing assembly 800 is not sealed, the pressure above and below the surface 526 is expected to be equal.

Flow Valve Assembly 600

The flow valve assembly 600 is adapted to close the interior fluid flow conducting passage 102 in response to an operating movement provided by the piston assembly 300 and transferred through the slip assembly 500 to the flow valve assembly 600.

According to the presently most preferred embodiment of the invention, the flow valve assembly 600 is a ball-valve assembly. It is to be understood, of course, that while a ball-valve is presently believed to be particularly advantageous, reliable, and secure for use in safety valve applications. In certain applications or with appropriate adaptations, other types of closing valves are contemplated as being useful according to the principles of the present invention, including, for example, a flapper valve. Based on the invention disclosure herein, a person of skill in the art would be able to adapt the principles of the present invention and the details of the presently most preferred embodiment to employ a different flow valve assembly such as a flapper valve.

Accordingly, the valve assembly 600 can include, for example, two ball operating arms 610 (only one of which is illustrated in the drawings), ball housing 630, and valve ball 690. The flow valve assembly can be selectively opened and closed to permit fluid flow through the central flow conducting passage 102 of the safety valve.

An intermediate coupling 612 for connecting the ball operating arms 610 to the collet sleeve portions 570 can be integrally formed with the collet sleeve 570 or can be connected to the collet sleeve portion 570 at a threaded connection. The coupling 612 includes outwardly extending flanges 616 and 618 at the lower end thereof, which define an exterior annular recess 620 there between.

The ball operating arms 610 include inwardly extending flanges 622 and 624 at the upper end thereof. When assembled in the lower housing section 230 of the housing 200, the outwardly extending flanges 616 and 618 at the lower end of the intermediate coupling 612 interlock with the inwardly extending flanges 622 and 624 of the ball operating arms 610. Intermediate coupling 612 and the ball operating arms 610 are maintained in engagement by their location in annular recess 626 between the inner wall surface of lower housing section 230 and the ball housing 630.

Accordingly, the ball operating arms 610 of the flow valve assembly 600 are operatively connected to the slip assembly 500 through the intermediate coupling 612.

Each of the two ball operating arms 610 has an inwardly protruding lug 628 for engaging and rotating the valve ball 690.

Ball housing 630 is of substantially tubular configuration having an interior fluid flow path there through 632 defined by the inner wall surface 634 of the ball housing 630. As will be described in more detail, the ball housing 630 preferably has an upper portion 636 and a lower portion 638. Ball housing 630 has two windows 640 in the wall thereof to accommodate the inward protrusion of lugs 628 on each of the two ball operating arms 610. The windows 640 in the ball housing 630 are defined by the downwardly-facing shoulder 642 of the upper portion 636 and the upwardly-facing shoulder 644 of the lower portion 638.

On the exterior of the ball housing 630, two longitudinal channels (the location of which is shown by phantom arrow 646) of arcuate cross-section and circumferentially aligned with windows 640, extend from shoulder 648 downward to shoulder 642. Ball operating arms 610, which are of substantially the same arcuate cross section as channels 646 and lower portion 638 of ball housing 630, lie in channels 646 and windows 640, and are maintained in place by the interior wall surface of the lower housing section 230 and the exterior wall surface of the lower portion 638 of the ball housing 630.

The interior of ball housing 630 has an upper annular seat recess 650, within which an annular upper ball seat 652 is disposed. Upper ball seat 652 has an arcuate metal-to-metal sealing surface 654, which provides a sliding seal with the exterior surface 692 of valve ball 690.

The interior of ball housing 630 also has a lower ball recess 656, within which an annular lower ball seat 658 is disposed. Lower ball seat 658 has an arcuate metal-to-metal sealing surface 660 that slidingly seals against the exterior surface 692 of valve ball 690.

Upper and lower ball seats 652 and 660 are preferably biased by a ring spring 662 into sealing engagement with the valve ball 690.

Exterior annular shoulder 664 on ball housing 630 is captured against the upper ends 666 of splines 668 (shown in phantom line) on the interior wall of lower housing section 230, whereby the flow valve assembly 600 of ball operating arms 610, ball housing 630, including the upper ball seat 652, the ring spring 654, and the lower ball seat 660, and the valve ball 690 positioned between the upper and lower ball seats 652 and 660 are all maintained in vertical position inside of lower housing section 230 of housing 200. Splines 668 engage splines 670 on the exterior wall of ball housing 630, and, thus, rotation of the ball housing 630 within lower housing section 230 is prevented.

The windows 640 in the ball housing 630 include windows formed in the upper portion 636 between downwardly-facing shoulder 644 and upwardly-facing shoulder 672 of the downward circumferential extension 674 of the upper portion 636. The downward circumferential extension 674 of the upper portion 636 is threaded to the lower portion 638, below the upwardly-facing shoulder 672, thereby forming the ball housing 630, and the windows 640 defined by the downwardly-facing shoulder 542 of the upper portion 636 and the upwardly-facing shoulder 644 of the lower portion 638.

Lower connector 250 protrudes at its upper end 256 between ball housing 630 and lower housing section 230 when made up with the lower portion 638 of ball housing 630 at threaded connection 254.

Valve ball 690 has a diametrical bore 694 therethrough of substantially the same diameter as bore 652 of ball housing 630. Two lug recesses 696 extend from the exterior surface 692 of valve ball 690 to bore 694.

When valve ball 690 is in its open position, as shown in FIG. 1B, a "full open" condition of the interior flow conducting passage 102 extends throughout the length of the safety valve 100, providing an unimpeded path for the movement of formation fluids and/or perforating guns, wireline instrumentation, etc. When valve ball 690 is in a closed position, as shown in FIGS. 2B and 3B, a "full closed" condition is created by the rotation of the valve ball 690 such that the bore 694 is no longer aligned with the interior fluid flow conducting passage 102 of the safety valve 100.

Circulating Valve Assembly 700

The circulating valve assembly 700 allows for selective circulation of well fluids between the interior fluid flow conducting passage 102 of the housing 200 and the exterior of the housing. According to the presently most preferred embodiment of the invention, circulating valve assembly 700 uses the principle of moving the orifices of inner and outer ports across a gate into and out of fluid communication. In general, this type of valve is referred to herein as a gate valve.

The inner wall surface of the upper housing section 220 has a circumferential inwardly-extending first isolating rib 710 formed thereon. The first isolating rib 710 has an upwardly-facing circumferential surface 712 and a downwardly-facing circumferential surface 714. An O-ring seal 716 seals the inner wall surface of the operating mandrel 310 below the mandrel piston 320 for slidable movement of the operating mandrel 310 against the first isolating rib 710. Essentially, the first isolating rib 710 functions as a valve gate.

The inner wall of the upper housing section 220 has a circumferential inwardly-extending second isolating rib 720 formed thereon. The second isolating rib 720 has an upwardly-facing circumferential surface 722 and a downwardly-facing circumferential surface 724. An O-ring seal 726 seals the inner wall surface of the operating mandrel 310 below the mandrel piston 320 for slidable movement of the operating mandrel 310 against the second isolating rib 720.

An isolating chamber 730 is a space defined by the inner wall of the upper housing section 220 and the outer wall of the operating mandrel 310, the upper end of which is defined by the downwardly-facing circumferential surface 714 of first isolating rib 710 and the lower end of which is defined by the upwardly-facing circumferential surface 722 of the second isolating rib 720. Isolating chamber 730 can be a channel, but more preferably is an annular space.

One or more housing ports 740 can be formed in the upper housing section 220 of the housing 200 at a location between the first isolating rib 710 and the second isolating rib 720. The housing port 740 allows fluid communication between the isolating chamber 730 and the exterior of the housing 200. If the isolating chamber 730 is annular in shape, then preferably, a plurality of housing ports 740 are spaced around the housing 200 to communicate exterior fluid pressure into the isolating chamber 730.

One or more mandrel ports 750 can be formed in the operating mandrel 310. The mandrel port 750 is located to be separated from the expansion chamber 330 over the full operating range of the operating mandrel 310. In the presently most preferred embodiment of the invention, the mandrel port 750 is located below the mandrel piston 320. If the isolating chamber 730 is annular in shape, then preferably, a plurality of mandrel ports 750 are spaced around the operating mandrel 310 to communicate interior flow passage fluid pressure into the isolating chamber 730, as will hereinafter be described in detail.

When the piston assembly 300 of the safety valve 100 is in the initial position shown in FIGS. 1A–B, the mandrel port 750 is positioned above the first isolating rib 710. When the piston assembly 300 slides to the position shown in FIGS. 2A–B, the mandrel port is still positioned above the first isolating rib 710. It is not until the piston assembly 300 is moved to the third position shown in FIGS. 3A–B that the mandrel port 750 slides past the first isolating rib 710 and provides fluid communication between the isolating chamber 730 and the interior flow passage 102 of the safety valve. Thus, the operating mandrel 310 and the first and second isolating ribs 710 and 720 isolate the housing port 740 from the interior flow passage 102 of the safety valve 100 until the piston assembly moves into the position shown in FIGS. 3A–B, whereby the mandrel port 750 is aligned with the isolating chamber 730.

Of course, when aligned in the position shown in FIGS. 3A–B, the housing port 740 and the mandrel port 750 provide relatively restricted fluid flow between the interior passage 102 and the exterior of the housing 200, which effectively creates a fluid choke. This effect can be advantageous used to gradually equalize the pressure between the interior passage 102 and the exterior of the housing.

The choking function can also be taken advantage of for the purpose of rapidly pumping up the fluid pressure in the interior fluid conducting passage 102, whereby a pressure drop is obtained across the fluid circulating valve assembly 700 between the interior and the exterior of the housing 200. Before the pressure is bled off through the open fluid circulating valve assembly 700, the interior fluid pressure can be developed sufficiently to overcome the exterior fluid pressure to drive the piston assembly 300 to close the fluid circulating valve assembly 700 and then re-open the flow valve assembly 600.

Biasing Assembly 800

The biasing assembly 800 creates a biasing force that facilitates the reliable operation of a safety valve 100 according to the invention. The biasing assembly 800 can be used to establish the amount of differential pressure between the interior flow conducting passage 102 and the exterior of the housing necessary to operate the safety valve 100. For example, the biasing assembly 800 preferably creates a biasing force that biases the piston assembly 300 of the safety valve 100 to move into a position that closes the flow valve assembly 600.

According to the presently most preferred embodiment of the invention, the biasing assembly 800 is a spring capturing subassembly 810 and a spring 850. In general, the spring capturing assembly 810 is for capturing and storing potential energy of the spring 850, which stored potential energy can be used to bias the operation of the piston assembly 300. The biasing assembly 800 preferably uses structural features already in the other assemblies of the safety valve 100.

For example, the spring capturing subassembly 810 can include the inner wall surface of the upper housing section 220, the outer wall surface of the operating mandrel 310 and the mandrel extension 520. A spring capturing rib 820 can be positioned on the outer wall of the mandrel extension 520. The spring capturing rib 820 has an upwardly-facing circumferential surface 822, a downwardly-facing circumferential surface 824, which function as the surface 526). An O-ring seal 826 seals the mandrel extension 520 for slidable movement against the inner wall surface of the piston housing 220. The chamber 830 is defined by the spring capturing subassembly 810.

If the spring 850 is preferably a mechanical spring as shown in the drawings. The spring 850 can be a gas spring, although a mechanical spring is expected to be simpler to design, build, and implement in a safety valve application. For example, if a gas spring is employed, it is necessary to seal and pressurize the spring chamber 830. In this regard, an O-ring seal 524 can be used to seal the threaded connection 522, as mentioned above.

Shear Pin Assembly 900

The shear pin assembly 900 is preferably employed with the biasing assembly 800 to prevent the biasing assembly from initially closing the flow valve assembly 600 of the safety valve during normal handling and assist in setting the initial position of the valve 100. According to the presently most preferred embodiment of the invention, the shear pin assembly 900 includes a shear pin receiving hole 910 formed in the lower end 214 of connector 210, shear pin port 912 formed in the upper end 312 of operating mandrel 310, and shear pin 914. As will be appreciated by those skilled in the art, the shear pin port 912 does not go all the way through the operating mandrel 310 to avoid the possibility of a fluid leak. The shear pin assembly 900 is adapted to shear or break when a predetermined amount of force is applied. According to the invention, one or more such shear pin assemblies 900 can be adapted for this purpose.

Operation of the Preferred Embodiment

Based on the foregoing description of the safety valve 100 and the accompanying drawings, the operation of the safety valve 100 according to the invention will be apparent to persons skilled in the art.

FIGS. 1A–B illustrate a safety valve 100 according to the presently most preferred embodiment of the invention in an initial position.

FIGS. 2A–B illustrate the safety valve shown in FIGS. 1A–B, after an excessive exterior fluid pressure has caused the rupture disks 420 to rupture, shearing the shear pins 914, and then at least assists in driving the operating piston assembly 300, acting through the slip assembly 500, to an intermediate position and close the flow valve assembly 600.

FIGS. 3A–B illustrate the safety valve 100 shown in FIGS. 1A–B, after the flow valve assembly 600 has been completely closed as shown in FIGS. 2A–B, at which point the slip assembly 500 performs its slipping function to allow the exterior fluid pressure to continue to at least assist in driving the piston assembly 300 through to a second position at which an interior port and an exterior port of the circulating valve 700 are in fluid communication. The exterior fluid pressure communicates with the interior of the safety valve 100 on the up-hole side of the flow valve assembly 600.

By pumping fluid from up-hole to increase the fluid pressure at a faster rate than can be bled off through the interior port and exterior port of the circulating valve assembly 700, the increased fluid pressure drives the operating piston assembly 300 back to the initial position, thereby selectively re-opening the circulating valve 700 and then re-closing the flow valve 600.

Scope of Invention Not Limited to Preferred Embodiments

The invention is described with respect to presently preferred embodiments, but is not intended to be limited to the described embodiments. It will be readily apparent to one of ordinary skill in the art that numerous such modifications may be made to the invention without departing from the spirit and scope of it as claimed.

What is claimed is:

1. A safety valve for downhole use in a well, the safety valve comprising:

(a) a housing having
  (i) an interior fluid flow passage therethrough and
  (ii) at least one circulating port in the housing for providing fluid communication between the interior fluid flow passage and the exterior of the housing;

(b) a piston operatively positioned within the housing for movement between a first position and a second position in response to a fluid pressure differential between the interior fluid flow passage and the exterior of the housing;

(c) a slip operatively connected to the piston, whereby
  (i) over a first range of the movement of the piston the slip moves with the piston, and
  (ii) over a second range of the movement of the piston the slip does not move with the piston;

(d) a flow valve operatively connected to the slip for opening and closing the interior fluid flow passage of the housing during the first range of the movement of the piston; and (e) a circulating valve operatively connected to the piston for opening and closing the circulating port during the second range of the movement of the piston.

2. A safety valve according claim 1, wherein when the piston moves from the first position to the second position, the flow valve closes and then the circulating valve opens; and when the piston moves in the reverse direction from the second position to the first position, the circulating valve closes and then the flow valve opens.

3. A safety valve according to any one of claim 1 or 2, wherein when the safety valve is oriented for downhole use, the circulating valve is located uphole of the flow valve.

4. A safety valve according to claim 1, wherein the housing is a housing assembly.

5. A safety valve according to claim 1, wherein the housing additionally comprises an upper connector and a lower connector for joining the safety valve into a tubing string.

6. A safety valve according to claim 1, additionally comprising an operating mandrel, wherein the piston is operatively connected to the operating mandrel.

7. A safety valve according to claim 6, wherein the slip is operatively connected to the piston through the operating mandrel.

8. A safety valve according to claim 7, wherein the circulating valve is operatively connected to the piston through the operating mandrel.

9. A safety valve according to claim 1, wherein the slip is a collet.

10. A safety valve according to claim 9, wherein the flow valve is a ball valve.

11. A safety valve according to claim 9, wherein the circulating valve is a gate valve.

12. A safety valve according to claim 1, additionally comprising:

a spring biasing the pressure differential required to drive the piston.

13. A safety valve according to claim 12, wherein the spring biases the piston to close the flow valve.

14. A safety valve according to claim 12, wherein the spring is a mechanical spring.

15. A safety valve according to any one of claim 1 or 12, additionally comprising:

a break-away release that breaks in response to a predetermined force related to the fluid pressure exterior of the housing, which break-away release breaks before the fluid pressure exterior of the housing causes the piston to move.

16. A safety valve according to claim 15, wherein the fluid pressure exterior of the housing communicates with one side of the piston through at least one port in the housing.

17. A safety valve according to claim 16, wherein the break-away release is a rupture disk positioned in the port in the housing that communicates fluid pressure exterior of the housing with one side of the piston.

18. A safety valve for downhole use in a well, the safety valve comprising:

(a) a housing having
(i) an interior fluid flow passage therethrough and
(ii) at least one circulating port in the housing for providing fluid communication between the interior fluid flow passage and the exterior of the housing;

(b) a piston operatively positioned within the housing for movement between a first position and a second position in response to a fluid pressure differential between the interior fluid flow passage and the exterior of the housing;

(c) a slip operatively connected to the piston, whereby
(i) over a first range of the movement of the piston the slip moves with the piston, and
(ii) over a second range of the movement of the piston the slip does not move with the piston;

(d) a first valve positioned within the housing for opening and closing the interior fluid flow passage of the housing;

(e) a second valve within the housing for opening and closing the circulating port;

(f) an operative connection between the slip and either one of the first and second valves, whereby the first range of the movement of the piston operates the one valve; and (g) an operative connection between the piston and the other one of the first and second valves, whereby the second range of the movement of the piston operates the other valve.

19. A safety valve according to claim 18, wherein when the piston moves from the first position to the second position, the first valve closes and then the second valve opens; and when the piston moves in the reverse direction from the second position to the first position, the second valve closes and then the first valve opens.

20. A safety valve according to any one of claim 18 or 19, wherein when the safety valve is oriented for downhole use, the second valve is located uphole of the first valve.

21. A safety valve according to claim 18, wherein the housing is a housing assembly.

22. A safety valve according to claim 18, wherein the housing additionally comprises an upper connector and a lower connector for joining the safety valve into a tubing string.

23. A safety valve according to claim 18, additionally comprising an operating mandrel, wherein the piston is operatively connected to the operating mandrel.

24. A safety valve according to claim 23, wherein the slip is operatively connected to the piston through the operating mandrel.

25. A safety valve according to claim 18, wherein the slip is operatively connected to the first valve.

26. A safety valve according to claim 24, wherein the slip is operatively connected to the first valve.

27. A safety valve according to claim 26, wherein the slip is a collet.

28. A safety valve according to claim 26, wherein the first valve is a ball valve.

29. A safety valve according to claim 26, wherein the second valve is a gate valve.

30. A safety valve according to claim 24, wherein the slip is a collet.

31. A safety valve according to claim 24, wherein the first valve is a ball valve.

32. A safety valve according to claim 24, wherein the second valve is a gate valve.

33. A safety valve according to claim 18, wherein the slip is a collet.

34. A safety valve according to claim 18, additionally comprising:

a spring biasing the pressure differential required to drive the piston.

35. A safety valve according to claim 34, wherein the spring biases the piston to close the first valve.

36. A safety valve according to claim 34, wherein the spring is a mechanical spring.

37. A safety valve according to any one of claim 18 or 34, additionally comprising:

a break-away release that breaks in response to a predetermined force related to the fluid pressure exterior of the housing, which break-away release breaks before the fluid pressure exterior of the housing causes the piston to move.

38. A safety valve according to claim 37, wherein the fluid pressure exterior of the housing communicates with one side of the piston through at least one port in the housing.

39. A safety valve according to claim 38, wherein the break-away release is a rupture disk positioned in the port in the housing that communicates fluid pressure exterior of the housing with one side of the piston.

40. A method of operating a downhole safety valve comprising the steps of:

(a) operatively mounting a piston in a housing for movement between a first position and a second position, (b) operatively connecting a slip to the piston, whereby
(i) over a first range of the movement of the piston the slip moves with the piston, and
(ii) over a second range of the movement of the piston the slip does not move with the piston;

(c) positioning a first valve within the housing for opening and closing an interior fluid flow passage of the housing;

(d) positioning a second valve within the housing for opening and closing a circulating port between the interior fluid flow passage and the exterior of the housing;

(e) operatively connecting the slip to one of the first and second valves, whereby the first range of the movement of the piston operates the one valve;

(f) operatively connecting the piston to the other one of the first and second valves, whereby the second range of the movement of the piston operates the other valve;

(g) exposing the piston to a fluid pressure differential between the interior fluid flow passage and the exterior of the housing to move the piston between the first position and the second position.

41. A method according to claim 40, wherein when the piston moves from the first position to the second position, the first valve closes and then the second valve opens; and when the piston moves in the reverse direction from the second position to the first position, the second valve closes and then the first valve opens.

42. A method according to any one of claim 40 or 41, wherein when the safety valve is oriented for downhole use, the second valve is located uphole of the first valve.

43. A method according to claim 40, wherein the step of operatively connecting the slip to one of the first and second valves further comprises: operatively connecting the slip to the first valve.

44. A method according to claim 40, additionally comprising the step of:

positioning a spring to bias the pressure differential required to drive the piston.

45. A method according to claim 40 or 44, additionally comprising the step of:

operatively positioning a break-away release that breaks in response to a predetermined force related to the fluid pressure exterior of the housing, which break-away release breaks before the fluid pressure exterior of the housing causes the piston to move.

46. A method according to claim 45, wherein the break-away release comprises a rupture disk operatively positioned between the piston and the fluid pressure exterior of the housing.

* * * * *